US006142465A

United States Patent [19]

Stahly

[11] Patent Number: 6,142,465

[45] Date of Patent: Nov. 7, 2000

[54] MAGNETIC END JUSTIFIER FOR A DROP STACKING MACHINE

[75] Inventor: Benjamin Stahly, Newton, Kans.

[73] Assignee: The Bradbury Company, Moundridge, Kans.

[21] Appl. No.: 08/982,620

[22] Filed: Dec. 2, 1997

[51] Int. Cl.[7] ..... B65H 29/34

[52] U.S. Cl. ..... 271/189; 271/207; 271/213; 271/214; 271/220; 414/788.9; 414/793.2

[58] Field of Search ..... 414/788.9, 793.2; 271/189, 207, 213, 214, 220

[56] References Cited

U.S. PATENT DOCUMENTS

| | | | |
|---|---|---|---|
| 2,015,809 | 10/1935 | Moore . | |
| 2,373,149 | 4/1945 | Strickler . | |
| 2,486,733 | 11/1949 | Buccicone . | |
| 2,527,911 | 10/1950 | Buccicone . | |
| 2,640,605 | 6/1953 | Chatterton . | |
| 2,766,043 | 10/1956 | Buccicone . | |
| 3,273,726 | 9/1966 | Buccicone . | |
| 3,920,132 | 11/1975 | Cleland et al. . | |
| 4,047,621 | 9/1977 | Stotzel et al. . | |
| 4,392,765 | 7/1983 | Barton et al. | 414/793.2 |
| 4,469,321 | 9/1984 | Geschwinder | 271/189 |
| 4,487,540 | 12/1984 | Buchheit | 414/793.2 |
| 4,566,833 | 1/1986 | Gigante | 414/793.2 |
| 4,905,979 | 3/1990 | Limbach et al. | 271/189 |
| 4,997,176 | 3/1991 | Hain | 271/189 |
| 5,123,807 | 6/1992 | Nakaoda et al. | 271/189 |
| 5,460,480 | 10/1995 | Jubre et al. | 414/793.2 |
| 5,493,104 | 2/1996 | Wilson | 271/189 |
| 5,562,281 | 10/1996 | Honda et al. . | |
| 5,570,995 | 11/1996 | Offoiach | 414/793.4 |

FOREIGN PATENT DOCUMENTS

| | | | |
|---|---|---|---|
| 61-188330 | 8/1986 | Japan | 414/797.1 |

*Primary Examiner*—Douglas Hess
*Attorney, Agent, or Firm*—Marshall, O'Toole, Gerstein, Murray & Borun

[57] ABSTRACT

A device for justifying an end of a section released from a drop stacking machine. A capture member for engaging an end of the section is slidably mounted to a frame and is shiftable between an extended capture position wherein the capture member is position to engage the end of the section to be dropped from the stacking machine and a retracted position. An end stop having a justifying surface is mounted to the frame. An actuator connected to the capture member shifts the capture member between the extended capture position and the retracted position, and in the process brings the section end into contact with the justifying surface. A control system having a sensor is provided for detecting the presence of a section waiting to be dropped from the stacker and in response thereto activating the actuator. Accordingly, when a section is dropped from the stacking machine the section end is captured by the capture member. Retraction of the capture member draws the section end into contact with the justifying surface until contact between the capture member and the section is broken.

26 Claims, 10 Drawing Sheets

MAGNETIC END JUSTIFIER FOR A DROP STACKING MACHINE

FIELD OF THE INVENTION

The present invention relates generally to a drop stacking machine for use with a roll forming machine. More specifically, the present invention relates to a magnetic end justifier for justifying the ends of steel sections being dropped onto a stack by a drop stacking machine in order facilitate packing of the stacked sections into a bundle for handling.

BACKGROUND OF THE INVENTION

Many steel products, such as steel sheets or corrugated steel panels, are typically formed into discrete sections on a continuous-feed roll forming line. Each section exits the line and rolls onto a drop stacking machine which has a number of roller supports. When the trailing edge of the steel section has exited the roll forming line, the roller supports on the drop stacking machine retract or swing out of the way, thus dropping the steel section onto the stack below. In order to simplify bundling or packaging of the stack for handling and subsequent transport, it is desirable that at least one end of the pile is straight or justified.

One common way by which to justify the stack is to physically tamp the section ends each time a new section is dropped onto the pile. Unfortunately, the tamping method tends to damage one end of the steel sections, and only works well when all of the sections are of the same overall length. Moreover, the tamping method requires a physical stop at the leading edge, which must be adjusted manually in order to accommodate the variety of lengths that may be produced on the roll forming line. Accordingly, there exists a need for an improved justifying device for a drop stacking machine.

SUMMARY OF THE INVENTION

According to one aspect of the invention, a device for justifying the ends of a pile of sections released from a drop stacking machine includes a frame and a capture member that is slidably connected to the frame. The capture member is shiftable between an extended capture position in which the capture member is disposed in a position to engage or catch one end of the section being dropped from the stacker, and a retracted position. An actuator engages the capture member, and enables the capture member to be shifted between the extended capture position and the retracted position. After the capture member engages a dropping section, the capture member is retracted, thus drawing the section towards and into contact with the end stop, thus aligning the end of the section with a justifying member or surface. A control system has a sensor for detecting a section to be dropped from the stacker, and is configured to activate the actuator at the proper point in time. Accordingly, when a section is released from the stacker, the capture member engages the section end and draws the section end into contact with the justifying surface as the capture member is shifted toward the retracted position. The section end contacts the stationary justifying surface, and continued retraction of the capture member breaks the contact between the capture member and the section.

In accordance with the preferred embodiment of the invention, the capture member includes a magnetic plate having a broad contact surface for engaging and capturing a ferrous section, and a linear thruster is employed in order to reciprocate the capture member back and forth along a generally linear path, preferably at an angle relative to the horizontal. The justifying surface of the stop member may also be magnetized in order to further enhance the justifying effects of the device. The capture member plate may be pivotally mounted to a subframe, which permits the plate and the attached section to pivot relative to the other components in order to accommodate the dropping section, which may not be falling evenly.

When in the extended or capture position, the capture member is preferably disposed under the end of the steel section. Upon retraction of the capture member, the capture member is preferably laterally removed from the section end, which occurs after the section end has contacted the justifying surface. In order to further enhance the justifying effects of the device, the justifying surface preferably includes a pair of vertical members, with the capture member extending from between the members when extended.

In accordance with another aspect of the invention, a justifying device for use on a drop stacking machine comprises a frame and a magnetic capture member for engaging an end of a ferrous member to be dropped from the stacking machine. A justifying surface or member is included for justifying the section end. The capture member is slidably mounted to the frame and is shiftable between a capture position wherein the capture member is positioned to engage one end of the ferrous section and a retracted position. An actuator shifts the capture member between the capture position and the retracted position, and a control system having a sensor for activating the actuator in response to the presence of a section to be dropped from the stacking machine.

In accordance with yet another aspect of the invention, a frame supports a magnetic capture member which engages an end portion of a steel section released from a drop stacking machine. The capture member is shiftably mounted on the frame and movable between an extended position and a retracted position. An actuator connected to the capture member shifts the capture member between the extended and retracted positions, thus drawing the steel section end into contact with a justifying surface. A control system is provided having a sensor for detecting the presence of the steel section waiting to be dropped from the stacking machine, and activates the actuator in response thereto.

In accordance with still another aspect of the invention, an end justifying device for use with a drop stacking machine includes a frame, a capture member connected to the frame for engaging an end portion of a section to be dropped from the stacking machine, and means carried by the frame for shifting the capture member between an extended capture position in front of the justifying surface and a retracted position behind the justifying surface. The capture member thus draws the section end into contact with a justifying surface.

An improved end justifying device for a drop stacker will improve end justification despite irregularities in the length of flat or formed steel sections. The present end justifying device is also equally suitable for use on the leading edge or the trailing edge of the sections, and by eliminating tamping will minimize or eliminate damage to the ends of the sections.

These and other objects, features and advantages of the invention will become readily apparent to those skilled in the art upon a reading of the following description.

DETAILED DESCRIPTION OF THE PREFERRED EMBODIMENT

The embodiments described herein are not intended to be exhaustive or to limit the scope of the invention to the precise forms disclosed. The following embodiments have been chosen and described in order to best explain the principles of the invention to enable others skilled in the art to follow its teachings.

Figure 6:
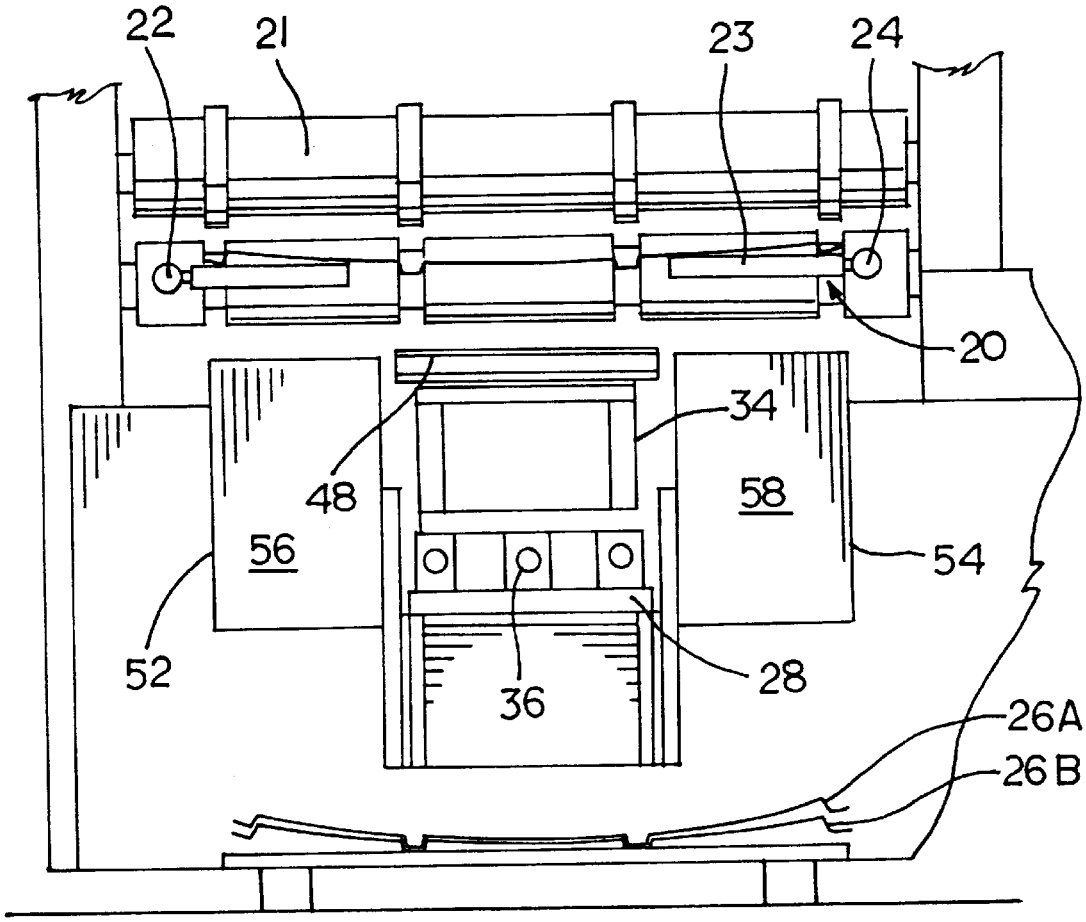
FIG. 6 is a fragmentary elevational view taken along lines 6—6 of FIG. 1 showing the capture member in the extended position ready to capture the next section.
Figure 7:
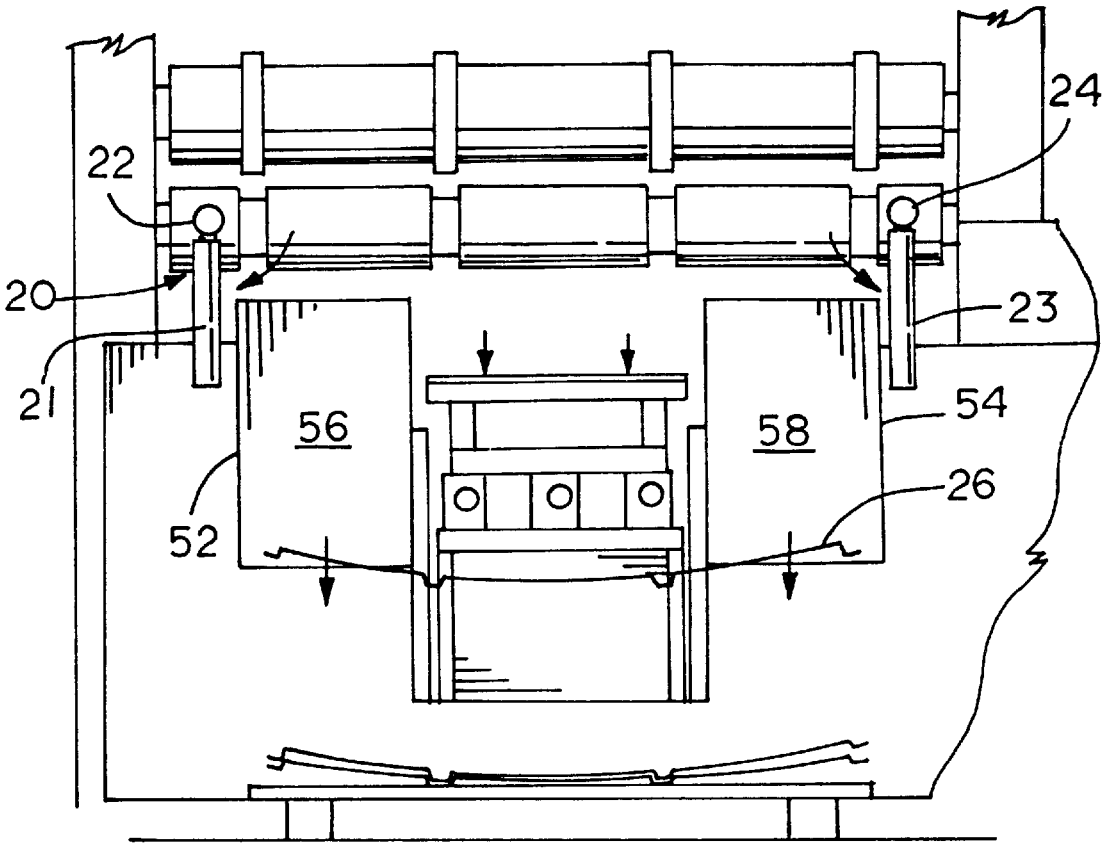
FIG. 7 is a fragmentary elevational view taken along lines 7—7 of FIG. 2 showing the section being released by the stacking machine and being captured by the capture member.
Figure 8:
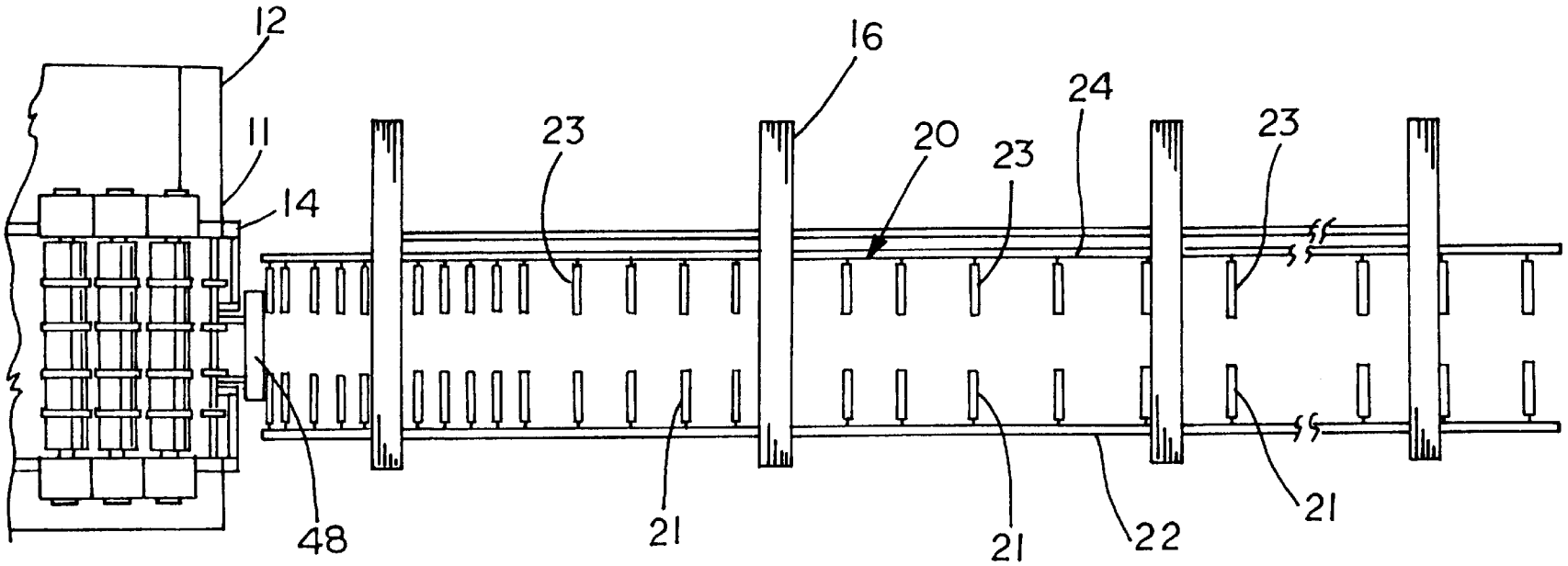
FIG. 8 is a top plan view of a roll forming machine and a drop stacking machine.

Referring now to the drawings, an end justifying device incorporating the features of the present invention is generally referred to by the reference numeral 10. Justifying device 10 is shown attached the output end 11 of a roll forming machine 12 having an exit roller 14. A drop stacking machine 16 having a retractable roller support 20 is positioned generally adjacent the output end 11 of the roll forming machine 12, with a roller support system 20 positioned at the same elevation as exit roller 14. As shown in FIGS. 6 and 7, the roller support system 20 includes opposing sets of retractable support rollers 21, 23, each of which is attached to a pivoting member 22, 24, as is known in the art. A steel section 26 having a leading end 27 and a trailing end 29 exits the roll forming machine 12 and is supported by the rollers 21, 23 of the roller support system 20 of drop stacking machine 16. In some instances, the roll forming machine 12 and the drop stacking machine 16 are capable of producing and receiving, respectively, steel sections 26 at two different elevations. However, for the sake of simplicity only the structure and operation of the lower elevation will be described in detail.

Figure 1:
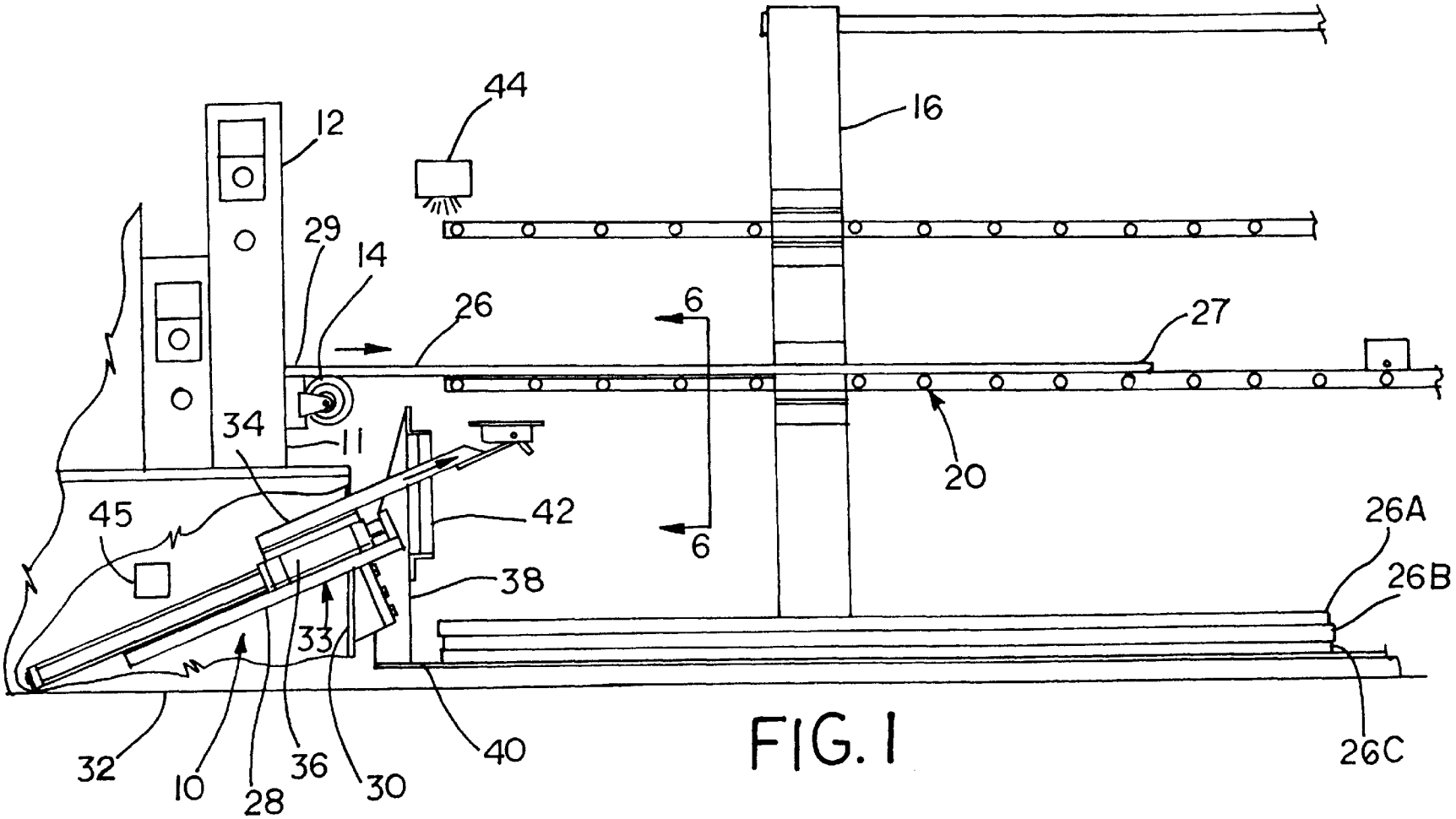
FIG. 1 is a fragmentary elevational view, partly in section, of an end justifying device incorporating the features of the present invention shown installed for use with a drop stacking device and showing a steel section exiting a roll forming machine.
Figure 2:
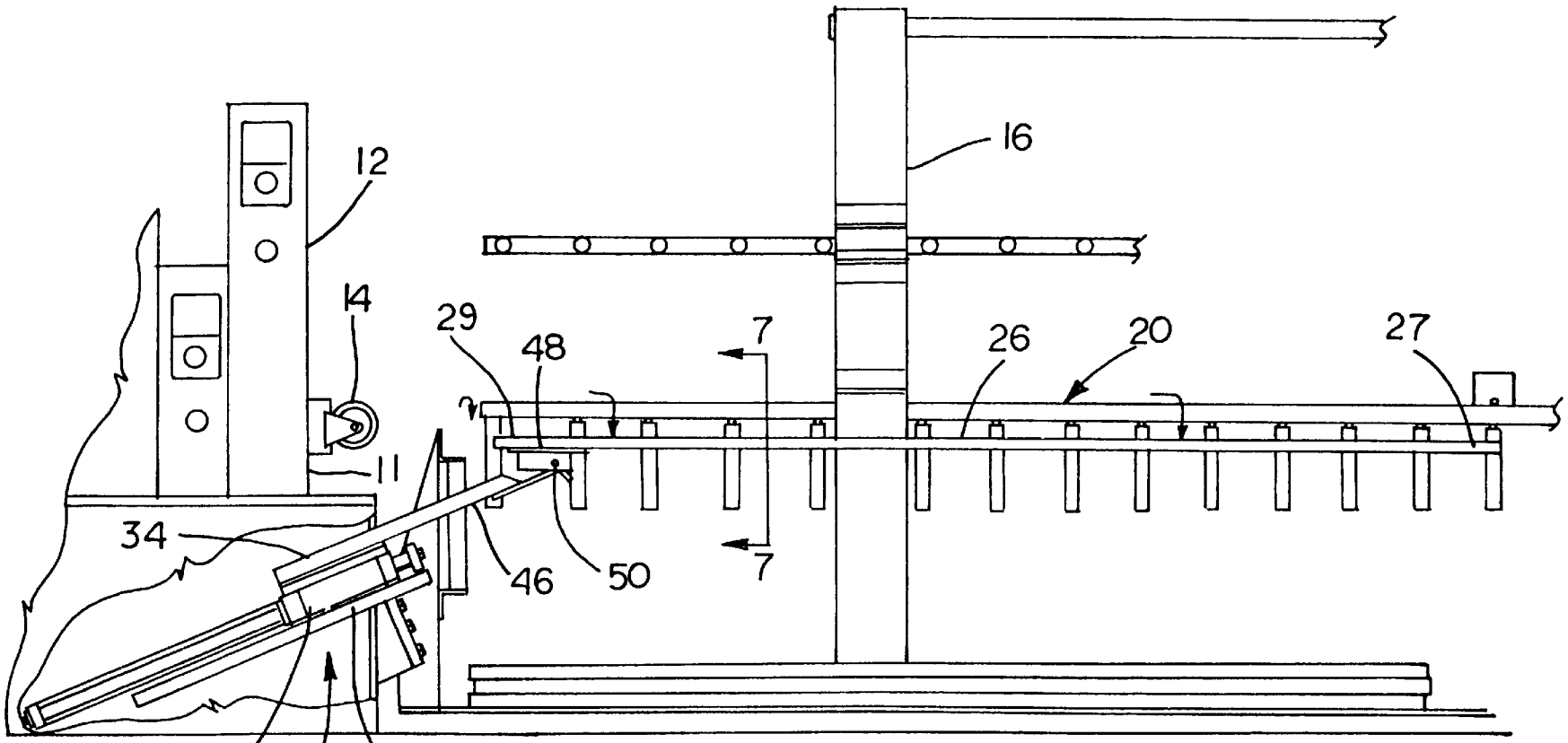
FIG. 2 is a fragmentary elevational view similar to FIG. 1 showing capture member in the extended position engaging the end of a steel section being released from the drop stacking machine.

End justifying device 10 includes a frame 28 which is mounted underneath and generally adjacent the exit roller 14 of roll forming machine 12. Frame 28 is bolted or otherwise secured to the frame 30 of roll forming machine 12 or alternatively to the ground or support surface 32. A capture assembly 33 includes a capture member 34 which is slidably mounted to a frame 28 so as to permit reciprocating movement between the extended position shown in FIG. 1 and the retracted position shown in FIG. 4. An actuator 36, such as a pneumatic cylinder or linear thruster as is commonly employed in the machine design industry, is employed in order to shift the capture member 34 between the extended and retracted positions. An end stop 38 is bolted or otherwise secured to either the support surface 32 or alternatively to the frame 40 of drop stacking machine 16. End stop 38 includes a generally vertical justifying surface 42.

A sensor 44 is positioned generally adjacent the exit roller 14 in order to detect the presence of a steel sheet 26 on support system 20. Sensor 44 is preferably a photoelectric sensor or other suitable device. Sensor 44 is operatively connected (not shown) to a controller 45, which in turn is connected to the actuator 36 of justifying device 10, in order to trigger the actuation of the capture assembly 33 in response to the presence of a steel section 26 on the support system 20 of drop stacking machine 16.

Figure 3:
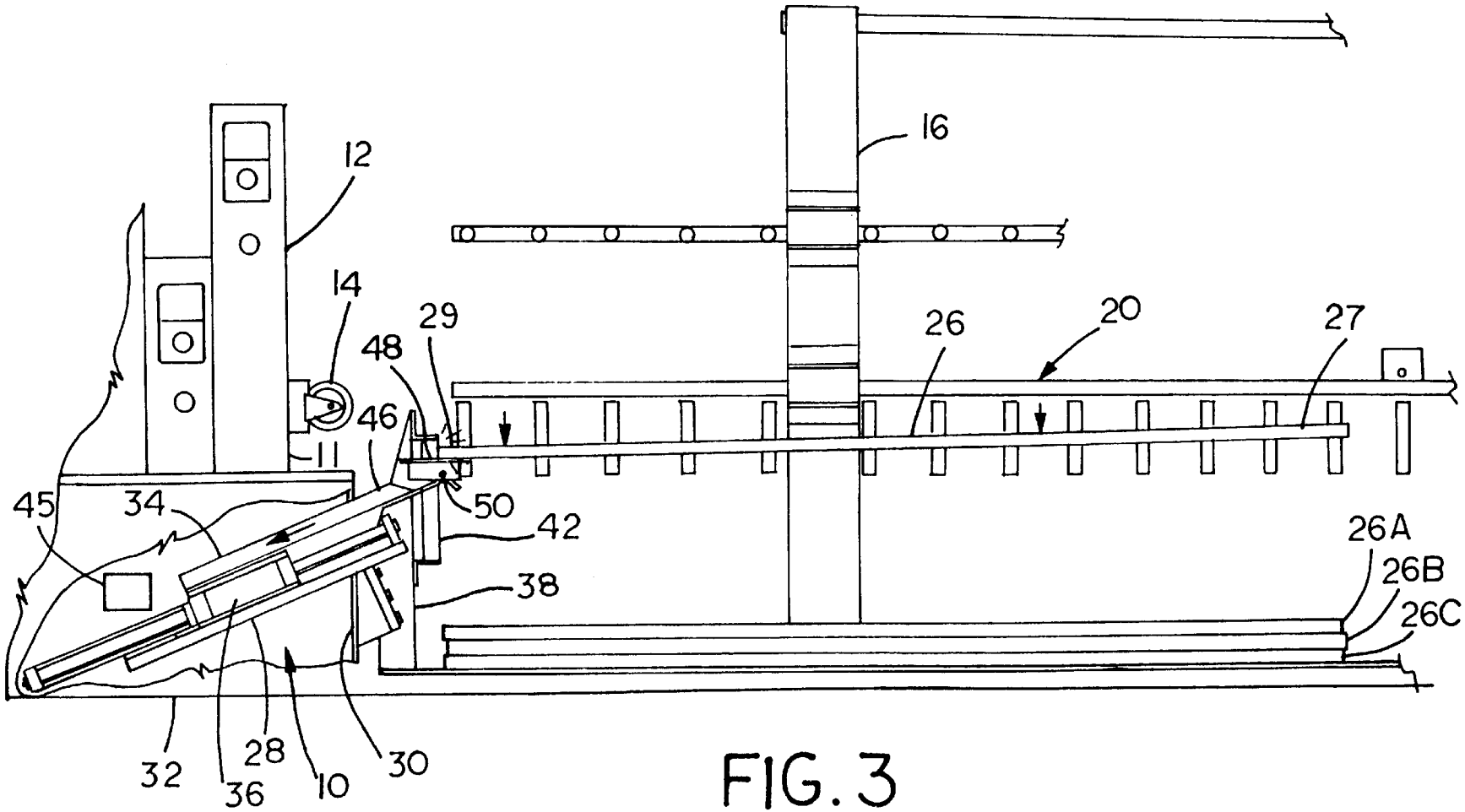
FIG. 3 is a fragmentary elevational view similar to FIGS. 1 and 2 showing the capture member being retracted by the actuator thereby drawing one end of the steel section downwardly and into contact with the justifying member.

Frame 34 of justifying device 10 includes a subframe 46 which extends away from frame 34 in cantilever fashion. A capture plate 48 is mounted to the end of subframe 46 by a pivot 50. Capture plate 48 preferably has a broad contact surface, and is preferably magnetic in order to engage the trailing end 29 of the steel section 26. Alternatively, the capture plate may be magnetized using electrical means as is well known in the art. Although the justifying device 10 is shown positioned so as to engage the trailing end 29 of steel section 26, it will be understood that the justifying device 10 can also be positioned so as to engage and justify the leading end 27 of steel section 26. Pivot 50 permits the capture plate 48 to pivot about a horizontal axis relative to the subframe 46 and frame 34, thus enabling capture plate 48 to maintain contact with the end 29 of the steel section 26 in the event the steel section 26 drops unevenly as is shown in FIG. 3.

As shown in FIGS. 6 and 7, end stop 38 preferably includes a pair of generally vertical members 52, 54, each of which has a generally planar magnetic surface 56, 58. Magnetic surfaces 56, 58 may be constructed of rare earth metals, or alternatively may be magnetized using electrical means. Also as shown in FIGS. 6 and 7, vertical members 52, 54 are spaced laterally and define a gap therebetween, and justifying device 10 is positioned so that a portion of the subframe 46 and the capture plate 48 protrudes from between the vertical members 52, 54. Thus, when the end justifying device 10 and its capture member 48 are in the extended capture position, the capture plate 48 is located generally to the front of the vertical members 52, 54 (which is to the right when viewing FIGS. 1 through 5). On the other hand, when the justifying device 10 is retracted, the capture plate 48 is positioned behind the vertical members 52, 54 (which is to the left when viewing FIGS. 1 through 5) when the justifying device 10 is in the retracted position.

In operation, a steel section 26 exits the roll forming machine 12 guided and supported by exit roller 14 to a position supported by the roller support system 20 of drop stacking machine 16 in a manner well known in the art. When the trailing end 29 of the steel section 26 has reached a predetermined location, such as directly over or slightly in front of the vertical plane of the justifying surface 42, the sensor 44 triggers the operation of the drop stacking machine 16 and the end justifying device 10. As shown in FIGS. 6 and 7, the opposing support rollers 21, 23 rotate about their respective pivotable support members 22, 24. When the support rollers 21, 23 shift from the generally horizontal supporting position of FIG. 6 to the release position of FIG. 7, the steel section 26 begins to fall. The trailing end 29 of the steel section 26 falls onto and engaged by the capture member 48, and is secured to capture member 48 by magnetic forces. At approximately the same point in time, the control system 45 initiates the movement of actuator 36 so that the capture assembly 33 and its attached plate 48 is quickly retracted from the extended position shown in FIG. 2 towards the retracted position of FIG. 3. The retraction of the capture member 48 causes the trailing end 29 of the steel section 26 to be pulled into contact with the justifying surfaces 56, 58 of justifying members 52, 54 as shown in FIG. 3 as the section 26 is pulled downwardly by gravitational forces and by the downward component of the retracting capture assembly 33. Also as shown in FIG. 3, frame 28 is preferably angled so that upon retraction of the capture member 48, the trailing end 29 of the steel section 26 is lowered faster than the leading end 27 as shown in FIG. 3. By virtue of pivot 50, the broad contact surface of capture member 48 retains maximum contact with the end of the steel section 26.

Figure 4:
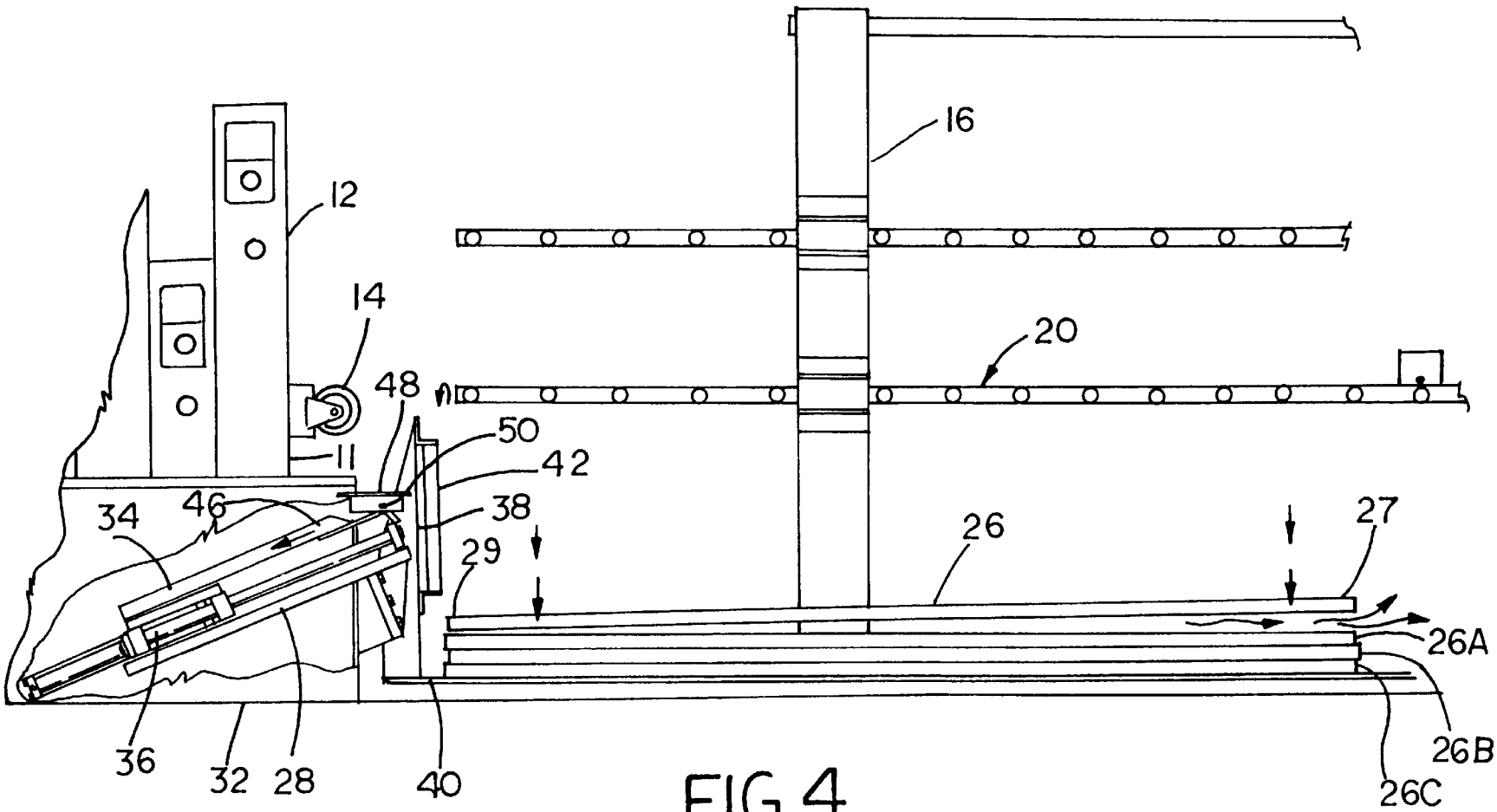
FIG. 4 is a fragmentary elevational view similar to FIGS. 1 through 3 but showing the capture member in the fully retracted position disengaged form the steel section and the drop stacking machine positioned to receive the next section.
Figure 5:
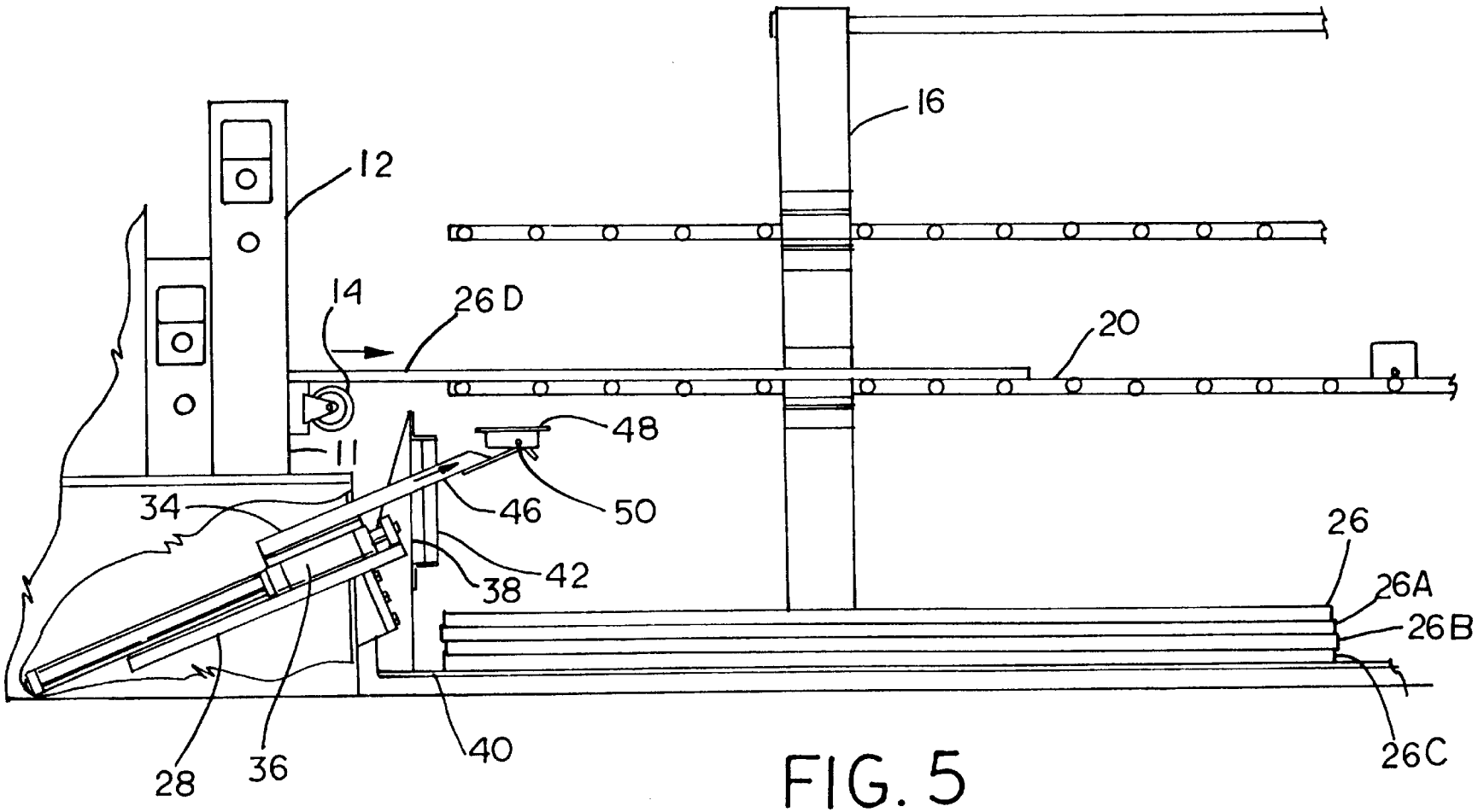
FIG. 5 illustrates the capture member being returned to the extended position under the steel section in preparation for the next section to be dropped.

The steel section 26 continues to fall downwardly by gravitational forces and pulled by the justifying device 10. The retraction of the subframe 34 and its attached capture member 48 continues to move the capture member from the position shown in FIG. 3 in which the trailing end 29 is spaced some distance away from and in front of the justifying surface 42 towards the position shown in FIG. 4 in which the trailing end 29 abuts the justifying surface 42. When the trailing end 29 of the steel section 26 contacts the justifying surfaces 56, 58 further lateral movement of the steel section is prevented. However, the subframe 34 and its attached capture member 48 continues to retract, so that the capture member 48 slides off the end of the steel section 26, and contact between the section 26 and the capture member 48 is broken. The steel section 26 then continues to fall onto a stack of previously dropped sections 26*a* through 26*c*, as shown in FIG. 4. As shown in FIG. 5, the justifying device 10 then returns to the extended position as a new steel section 26*d* is rolled onto the drop stacking machine 16, and the process is repeated.

Figure 9:
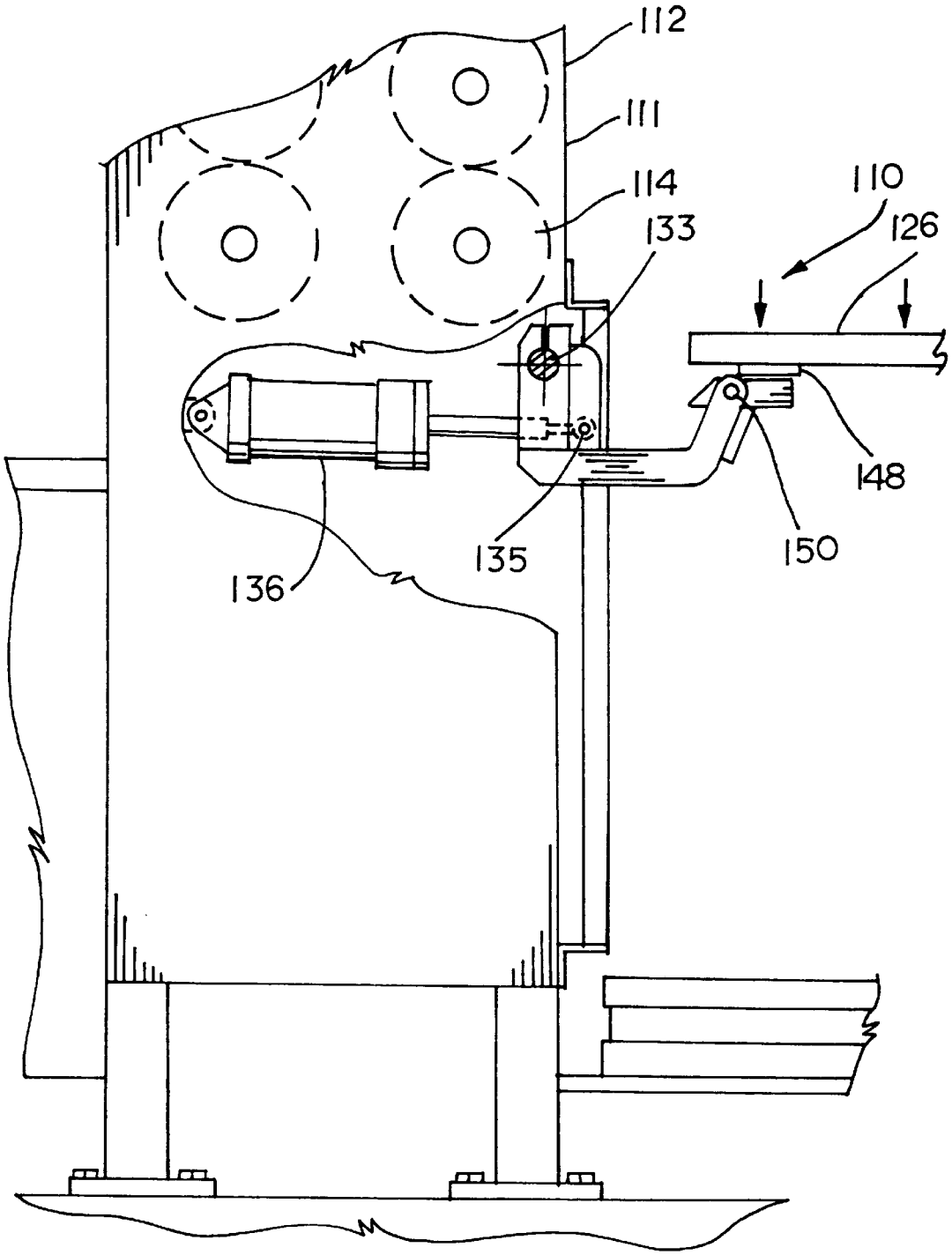
FIG. 9 is a fragmentary elevational view, partly in section, illustrating a second embodiment of the present invention and showing a section being captured by the capture mechanism.
Figure 10:
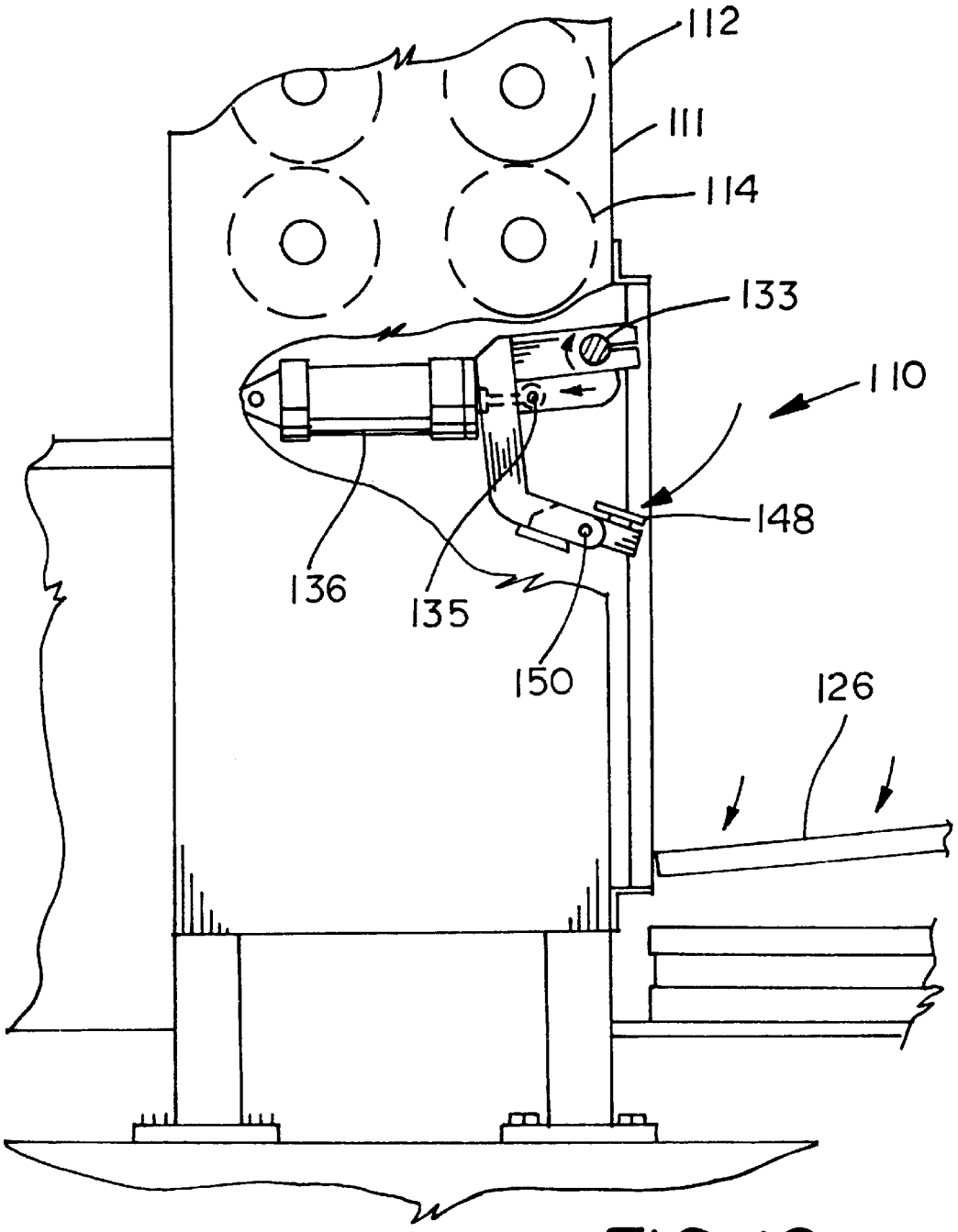
FIG. 10 is a fragmentary elevational view similar to FIG. 9 showing the capture mechanism in the retracted position.

Referring now to FIGS. 9 and 10, an alternative embodiment of the present invention is shown and is referred to by the reference numeral 110. All elements that are the same or similar to those have been assigned the same reference number, but increased by 100. End justifying device 110 is positioned adjacent the output end 111 of a roll forming machine 112 having an exit roller 114. A drop stacking machine (not shown) having a retractable roller assembly (not shown) is positioned so as to support a steel section 126 exiting the roll forming machine 112 at the exit roller 114. Justifying device 110 includes a frame 128 which supports a pivot arm 131 which pivots about pivot 133. An actuator 136 is connected to pivot arm 131 at a pivot 135. Preferably, pivot 135 is offset from pivot 133. A subframe 146 extends in cantilever fashion away from the roll forming machine 112 as shown in FIG. 9. A capture member 148, which is preferably a magnetized plate, is supported on subframe 146 by a pivot 150. Subframe 136, by virtue of the actuator 136, is shiftable between the extended capture position shown in FIG. 9 and the retracted position shown in FIG. 10. Preferably, a controller (not shown) having a sensor (not shown) is configured to activate the actuator 136 in response to the presence of a steel section 126 waiting to be dropped from the drop stacking machine 16.

It will be understood that the above descriptions do not limit the invention to the above given details. It is contemplated that various modifications and substitutions can be made without departing from the spirit and scope of the following claims.

What is claimed:

1. A device for justifying a first end of a section released from a drop stacking machine, the section having the first end, a second end, and a pair of elongated sides extending between and being longer than the first and second ends, the device comprising:

a frame;

a capture member for engaging the first section end, the capture member being slidably mounted to the frame and being shiftable between an extended capture position wherein the capture member is positioned to engage the first section end and a retracted position;

an end stop having a justifying surface for contacting and justifying the first section end, the justifying surface being disposed generally parallel to the first section end and non-parallel to the elonoated sides; and an actuator engaging the capture member for shifting the capture member between the extended capture position and the retracted position, the actuator being arranged to shift the capture member along a path, the path being non-parallel to the justifying surface while the first section end is in contact with the justifying surface;

so that the capture member engages the first section end and draws the first section end into contact with the justifying surface as the capture member is shifted toward the retracted position.

2. The device of claim 1, wherein the section is ferrous and the capture member includes a magnetic portion.

3. The device of claim 1, wherein the actuator is a linear thruster.

4. The device of claim 1, wherein the capture member is moveable along a linear path oriented at an angle relative to the horizontal.

5. The device of claim 1, wherein the capture member includes a subframe engaging the actuator and further includes a capture plate pivotally connected to the subframe.

6. The device of claim 5, wherein the section is ferrous and the capture plate is magnetic.

7. The device of claim 1, including a controller having a sensor for detecting a section to be dropped from the stacker and activating the actuator in response thereto.

8. An end justifying device for use on a drop stacker, the drop stacker being adapted to receive and drop a ferrous section having a pair of ends and a pair of elongated sides, the sides extending between and being longer than the ends, the end justifying device comprising:

a frame;

a magnetic capture member for engaging one end of the ferrous section, the capture member being slidably mounted to the frame and being shiftable along a path between a capture position wherein the capture member is positioned to engage the one end of the section and a retracted position;

a justifying member for justifying the one end of the section, at least a portion of the justifying member defining a justifying surface, the justifying surface being non-parallel to the elongated sides, the path being non-parallel to the justifying surface while the one end of the section is being justified; and an actuator for shifting the capture member between the capture position and the retracted position;

so that the capture member engages and justifies the one end of the dropped section.

9. The device of claim 8, wherein the actuator is a linear thruster.

10. The device of claim 8, wherein the capture member is moveable along a linear path oriented at an angle relative to the horizontal.

11. The device of claim 8, wherein the capture member includes a subframe engaging the actuator, and further includes a magnetic plate pivotally connected to the subframe.

12. The device of claim 8, wherein the justifying member includes a generally vertical justifying surface.

13. The device of claim 8, including a controller having a sensor for activating the actuator.

14. An end justifying device for use with a drop stacking machine, the drop stacking machine being adapted to receive and then release a steel section having a pair of end portions and a pair of elongated sides, the sides extending between and being longer than the end portions, the end justifying device comprising:

a frame;

a magnetic capture member for engaging one of the end portions of the steel section released from the drop stacking machine, the capture member being shiftably mounted to the frame and moveable between an extended position and a retracted position along a path;

a justifying member defining a justifying surface, the justifying surface being disposed parallel to the one end portion and further being disposed at an angle relative to the path; and an actuator operatively connected to the capture member for shifting the capture member between the extended and retracted positions, the actuator being arranged so that the one end portion slides relative to the capture member as the capture member draws the one end portion into contact with the justifying surface;

whereby upon release of a section from the drop stacking machine the capture member brings the one section end into contact with the justifying surface.

15. The device of claim 14, including a controller having a sensor for detecting a section to be dropped from the stacker and activating the actuator in response thereto.

16. An end justifying device for use with a drop stacking machine, the drop stacking machine being adapted to receive and drop a section having a pair of elongated sides and a pair of transverse end portions extending between and being substantially shorter than the sides, the end justifying device comprising:

a frame;

a capture member connected to the frame for engaging one of the end portions of the section to be dropped from the drop stacking machine;

a first justifying member having a vertical dimension and defining a justifying surface;

means carried by the frame for shifting the capture member between an extended capture position in front of the justifying surface and a retracted position behind the justifying surface, the means further for moving the capture member along a path disposed non-parallel to the justifying surface, the capture member moving alone the path as the one end portion is in contact with the justifying surface, thereby justifying the one end portion without using a second justifying member having a vertical dimension equal to the first justifying member adjacent a second one of the end portions.

17. The device of claim 16, wherein the means is adapted to move the capture member along a generally arcuate path.

18. The device of claim 16, wherein the means is adapted to move the capture member along a linear path.

19. An end justifying device for use on a processing machine having an exit point, the end justifying device comprising:

a drop stacking machine positioned to accept an elongated section exiting the processing machine at the exit point, the elongated section including a first end, a second end, and a pair of interconnecting sides extending between and being longer than the ends; and an end justifying mechanism positioned to engage one of the ends of the section and align the one end with a justifying surface, the justifying surface being disposed parallel to the one end, the end justifying mechanism including a frame, a capture member shiftably connected to the frame and being shiftable between an extended capture position and a retracted position, and an actuator for shifting the capture member between the extended and retracted positions, the actuator and the capture member being adapted to move the capture member alone a paths the path being non-parallel to the justifying surface as the one end is being aligned with the justifying surface.

20. A device for justifying an end of a ferrous section released from a drop stacking machine, comprising:

a frame;

a capture member for engaging the section end, the capture member including a magnetic portion, the capture member being slidably mounted to the frame and being shiftable between an extended capture position wherein the capture member is positioned to engage the section end and a retracted position;

an end stop having a justifying surface for contacting and justifying the section end, the justifying surface including a magnetic portion; and an actuator engaging the capture member for shifting the capture member between the extended capture position and the retracted position;

so that upon the release of a section from the stacker the capture member engages the section end and draws the section end into contact with the justifying surface as the capture member is shifted toward the retracted position.

21. A device for justifying an end of a section released from a drop stacking machine, comprising:

a frame;

a capture member for engaging the section end, the capture member being slidably mounted to the frame and being shiftable between an extended capture position wherein the capture member is disposed under the section in a position to engage the section end, and a retracted position wherein the capture member is disposed laterally removed from the section end;

an end stop having a justifying surface for contacting and justifying the section end; and an actuator engaging the capture member for shifting the capture member between the extended capture position and the retracted position;

so that upon the release of a section from the stacker the capture member engages the section end and draws the section end into contact with the justifying surface as the capture member is shifted toward the retracted position.

22. A device for justifying an end of a section released from a drop stacking machine, comprising:

a frame;

a capture member for engaging the section end, the capture member being slidably mounted to the frame and being shiftable between an extended capture position wherein the capture member is positioned to engage the section end and a retracted position;

an end stop having a pair of generally vertical members, each of the members having a magnetic justifying surface for contact by and justification of the section end, the members being disposed so that the capture member extends therebetween when the capture member is in the extended position; and an actuator engaging the capture member for shifting the capture member between the extended capture position and the retracted position;

so that upon the release of a section from the stacker the capture member engages the section end and draws the section end into contact with the justifying surface as the capture member is shifted toward the retracted position.

23. An end justifying device for use on a drop stacker, comprising:

a frame;

a magnetic capture member for engaging an end of a ferrous section to be dropped from the stacker, the capture member being slidably mounted to the frame and being shiftable between a capture position wherein the capture member is positioned to engage an end of the section and a retracted position;

a justifying member including a magnetic justifying surface, the justifying member for justifying the section end; and an actuator for shifting the capture member between the capture position and the retracted position;

so that the capture member engages and justifies the end of the dropped section.

24. An end justifying device for use on a drop stacker, comprising:

a frame;

a magnetic capture member for engaging an end of a ferrous section to be dropped from the stacker, the capture member being slidably mounted to the frame and being shiftable between a capture position wherein the capture member is disposed under the section end and positioned to engage the section end, and a retracted position wherein the capture area is laterally removed from the section end;

a justifying member for justifying the section end; and an actuator for shifting the capture member between the capture position and the retracted position;

so that the capture member engages and justifies the end of the dropped section.

25. An end justifying device for use on a drop stacker, comprising:

a frame;

a magnetic capture member for engaging an end of a ferrous section to be dropped from the stacker, the capture member being slidably mounted to the frame and being shiftable between a capture position wherein the capture member is positioned to engage an end of the section and a retracted position;

a pair of generally vertical members for justifying the section end, each of the vertical members including a generally vertical magnetic justifying surface, the capture member being adapted to extend between and in front of the justifying members when in the capture position; and an actuator for shifting the capture member between the capture position and the retracted position;

so that the capture member engages and justifies the end of the dropped section.

26. The device of claim 25, wherein the capture member is positioned behind the vertical members when in the retracted position.

* * * * *